US007728804B2

(12) United States Patent
Park et al.

(10) Patent No.: US 7,728,804 B2
(45) Date of Patent: Jun. 1, 2010

(54) LIQUID CRYSTAL DISPLAY DEVICE AND DRIVING METHOD THEREOF

(75) Inventors: Sung Chul Park, Kumi-shi (KR); Do Sung Kim, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 265 days.

(21) Appl. No.: 10/448,130

(22) Filed: May 30, 2003

(65) Prior Publication Data

US 2004/0125066 A1 Jul. 1, 2004

(30) Foreign Application Priority Data

Dec. 30, 2002 (KR) ..... 10-2002-0087009

(51) Int. Cl.
*G09G 3/36* (2006.01)

(52) U.S. Cl. ..... 345/90; 345/209; 349/128; 349/136

(58) Field of Classification Search ..... 345/92, 345/93, 87, 90, 94, 96, 98–100, 209, 211, 345/88, 89, 206; 349/123, 124, 128, 134, 349/139, 155, 136, 177, 179
See application file for complete search history.

(56) References Cited

U.S. PATENT DOCUMENTS

| | | | | |
|---|---|---|---|---|
| 4,691,995 | A | 9/1987 | Yamazaki et al. | |
| 5,309,264 | A | 5/1994 | Lien et al. | |
| 5,608,556 | A | 3/1997 | Koma | |
| 5,666,179 | A | 9/1997 | Koma | |
| 6,084,562 | A * | 7/2000 | Onda | 345/94 |
| 6,100,953 | A | 8/2000 | Kim et al. | |
| 6,373,456 | B1 * | 4/2002 | Matsubara | 345/94 |
| 6,411,359 | B1 * | 6/2002 | Kobayashi et al. | 349/149 |
| 6,421,039 | B1 * | 7/2002 | Moon et al. | 345/100 |
| 6,525,797 | B2 * | 2/2003 | Tsuda et al. | 349/139 |
| 6,628,253 | B1 * | 9/2003 | Hiroki | 345/87 |
| 6,798,471 | B2 * | 9/2004 | Yamada | 349/106 |
| 6,940,481 | B2 * | 9/2005 | Konno et al. | 345/96 |
| 7,030,869 | B2 * | 4/2006 | Morita | 345/208 |

(Continued)

FOREIGN PATENT DOCUMENTS

EP 0884626 A2 12/1998

(Continued)

OTHER PUBLICATIONS

Y. Tanaka, et al. "Late-News Paper: A New Design to Improve Performance and Simplify the Manufacturing Process of High-Quality MVA TFT-LCD Panels." SID 99 Digest, pp. 206-209.

*Primary Examiner*—Henry N Tran
(74) *Attorney, Agent, or Firm*—McKenna Long & Aldridge LLP

(57) ABSTRACT

A liquid crystal display device includes a thin film transistor arranged at crossings of gate lines and data lines; a pixel electrode connected to each thin film transistor; a common electrode arranged on a second substrate; a layer of liquid crystal material provided between the first and second substrates; a protrusion arranged on the common electrode for controlling an orientation of the liquid crystal molecules within the layer of liquid crystal material; and a common voltage generator applying an AC common voltage to the common electrode, wherein a polarity of the common voltage is inverted every predetermined period.

5 Claims, 11 Drawing Sheets

U.S. PATENT DOCUMENTS

| | | | | |
|---|---|---|---|---|
| 7,142,203 | B2 * | 11/2006 | Hiroki et al. | 345/209 |
| 2001/0050744 | A1 * | 12/2001 | Song et al. | 349/139 |
| 2003/0142257 | A1 * | 7/2003 | Chaudhari et al. | 349/129 |
| 2003/0189537 | A1 * | 10/2003 | Yun | 345/87 |

FOREIGN PATENT DOCUMENTS

| | | |
|---|---|---|
| JP | 6235925 | 8/1994 |
| JP | 08-022023 | 1/1996 |
| JP | 8101395 | 4/1996 |
| JP | 9061829 | 3/1997 |
| JP | 09-185037 | 7/1997 |
| JP | 10177178 | 6/1998 |
| JP | 10333157 | 12/1998 |
| JP | 10333159 | 12/1998 |
| JP | 11133438 | 5/1999 |
| JP | 11142864 | 5/1999 |
| JP | 11248930 | 9/1999 |
| JP | 11326922 | 11/1999 |
| WO | WO-00/08521 | 2/2000 |

* cited by examiner

FIG.2A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.2B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

FIG.5A

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG.5B

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 7A

| | | | | | | | |
|---|---|---|---|---|---|---|---|
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |

FIG. 7B

| | | | | | | | |
|---|---|---|---|---|---|---|---|
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |

1) CLASSIFICATION
: 5V

2) VIEWING ANGLE PROPERTY
: LEFT / RIGHT : 80/80
TOP / BOTTOM : 40/40

1) CLASSIFICATION
: 10V

2) VIEWING ANGLE PROPERTY
: LEFT / RIGHT : 80/80
TOP / BOTTOM : 80/80

LIQUID CRYSTAL DISPLAY DEVICE AND DRIVING METHOD THEREOF

This application claims the benefit of Korean Patent Application No. P2002-87009, filed on Dec. 30, 2002, which is hereby incorporated by reference for all purposes as if fully set forth herein.

BACKGROUND OF THE INVENTION

1. Field of the Invention

The present invention relates to a liquid crystal display device and a driving method thereof. More particularly, the present invention relates to a liquid crystal display device and a driving method thereof, wherein a viewing angle may be expanded by altering a common voltage applied to liquid crystal cells of a liquid crystal display device.

2. Description of the Related Art

Generally, liquid crystal display (LCD) devices are smaller and thinner than cathode ray tubes (CRTs), consume less power than CRTs, and display images by controlling light transmittance characteristics of liquid crystal material via data signals generated in response to video signals (e.g., television signals).

Of the various types of LCD devices, Active matrix LCD (AM-LCD) are excel in displaying moving images. Accordingly, AM-LCD devices generally include a LCD panel supporting a plurality of gate lines, a plurality of data lines crossing the gate lines wherein a plurality of liquid crystal cells (i.e., pixels), defined by the crossings of the gate and data lines, are arranged in a matrix pattern. Switching devices such as thin film transistors (TFTs) are provided within the liquid crystal cells. Arranged at crossings of the gate and data lines, the TFTs transmit data signals applied to the data lines to a corresponding pixel electrode in response to a scan signal applied to a corresponding gate line. Accordingly, light transmittance characteristics of each liquid crystal cell may be selectively controlled in accordance with a voltage level of the data signals applied to the data lines.

Recent developments have suggested that viewing angles of LCD devices may be increased by adjusting an alignment direction of liquid crystal material within different regions (i.e., sub-pixels or domains) within a liquid crystal cell.

FIG. 1 illustrates a sectional view of a LCD panel in a related art, two-domain twisted-nematic (TN) mode LCD device.

Referring to FIG. 1, the related art LCD panel includes a TFT array substrate 34, a color filter array substrate 32 opposing the TFT array substrate 34, and a layer of liquid crystal material 22 arranged between the color filter and TFT array substrates 32 and 34, respectively.

The TFT array substrate 34 includes a lower substrate 11; a plurality of data lines 14 formed on an insulating layer 12; a plurality of gate lines (not shown) crossing the plurality of data lines 14 and divide the lower substrate 11 into a plurality of liquid crystal cells; a plurality of TFTs (not shown) each consisting of a semiconductor layer (not shown) and a source/drain electrode (not shown); a protective film 10 covering and protecting the thin film transistors; a plurality of pixel electrodes 8 formed within pixel areas of each of the liquid crystal cells on the protective film 10 and connected to respective ones of the TFTs; and a lower alignment film 6*a* covering the pixel electrode 8.

The color filter array substrate 32 includes an upper substrate 1; a black matrix 2 formed on the upper substrate 1 for preventing light leakage in regions corresponding to the gate line, the data line 14, and the TFT (not shown); a plurality of color filters 4 arranged between the black matrix 2 and opposing the pixel areas; a common electrode 18 formed over the color filters 4; a protrusion 20, made of an organic material such as an acrylic resin, formed on each common electrode 18 and over each color filter 4; and an upper alignment film 6*b* formed on the protrusion 20.

Generally, when a voltage is applied to the LCD panel, an electric field is generated within the liquid crystal layer 22 that drives the liquid crystal molecules within a liquid crystal cell. Where the upper alignment film 6*b* is formed on the protrusion 20, a projected area 16 is formed that distorts the electric field generated within the liquid crystal layer 22. Accordingly, a dielectric energy of the distorted electric field orients directors of liquid crystal molecules in the layer of liquid crystal material 22 in desired directions.

Two-domain TN mode LCD devices such as those illustrated in FIG. 1 must be driven using a pixel voltage signal having a voltage level that is higher compared to the common voltage to effect a change in the orientation of the liquid crystal molecules arranged proximate the projected area 16. Due to the presence of the projected area 16, pixel voltage signals used in driving liquid crystal cells of two-domain TN mode LCD devices such as those illustrated in FIG. 1 must be about 2V higher than pixel voltage signals are used in driving liquid crystal cells of general TN mode LCD devices. However, data drivers capable of generating such high pixel voltage signals can be prohibitively expensive. Further, effecting an adequate orientation change in liquid crystal molecules arranged proximate the projected area 16 is more difficult than effecting an adequate orientation change in liquid crystal molecules in other areas of the liquid crystal cell. Therefore, viewing angle characteristics of LCD devices such as those illustrated in FIG. 1 can be undesirably degraded or narrowed, thereby requiring the addition of a wide viewing angle film.

Problems related to narrow viewing angles often arise when LCD devices such as those illustrated in FIG. 1 are driven according to a dot inversion scheme. Upon driving LCD devices according to the dot inversion scheme, the polarity of a pixel voltage signal applied to any one liquid crystal cell is opposite the polarity of a pixel voltage signal applied to all adjacent liquid crystal cells, wherein the polarities are opposite with respect to a common voltage. Further, the polarities of the pixel voltage signals applied to the liquid crystal cells are inverted every frame.

For example, and referring to FIG. 2A, during odd frames, a polarity of the pixel voltage signals applied to liquid crystal cells in even numbered rows of odd numbered columns is negative while a polarity of the pixel voltage signals applied to liquid crystal cells in odd numbered rows of even numbered columns is positive. During even frames as shown in FIG. 2B, a polarity of the pixel voltage signals applied to liquid crystal cells in odd numbered rows of even numbered columns is negative while a polarity of the pixel voltage signals applied to liquid crystal cells in even numbered rows of odd numbered columns is positive.

FIG. 3 illustrates a waveform diagram of the relationship between a pixel voltage signal (Vd) and a common voltage (Vcom) applied to liquid crystal cells of the related art LCD device illustrated in FIG. 1, driven according to the dot inversion scheme.

Referring to FIG. 3, according to the aforementioned dot inversion driving scheme, pixel voltage signals (Vd) having positive and negative polarities are alternately applied to liquid crystal cells as AC-type voltages during a horizontal period while a common voltage (Vcom) is commonly applied to the liquid crystal cells as a DC-type voltage. When a voltage difference between the common voltage Vcom and the pixel voltage Vd is about 5V, an orientation of liquid crystal molecules arranged proximate the projected area 16 of the upper alignment film 6*b* is not altered. Therefore, a larger voltage difference must be generated. Related art solutions typically employ a data driver capable of generating pixel voltage signals (Vd) having larger voltage levels in order to increase the voltage difference. However, these data drivers can be prohibitively expensive.

SUMMARY OF THE INVENTION

Accordingly, the present invention is directed to a liquid crystal display device capable and a driving method thereof, wherein a viewing angle may be expanded by altering a common voltage applied to liquid crystal cells of a liquid crystal display device that substantially obviates one or more of the problems due to limitations and disadvantages of the related art.

To achieve these and other advantages and in accordance with the purpose of the present invention, as embodied and broadly described, a liquid crystal display device may, for example, include a thin film transistor arranged at a crossing of gate lines and data lines arranged on a first substrate; a pixel electrode connected to the thin film transistor; a common electrode on a second substrate; a layer of liquid crystal material between the first and second substrates; a protrusion on the common electrode for controlling an orientation of the layer of liquid crystal molecules within the layer of liquid crystal material; and a common voltage generator for applying an AC common voltage to the common electrode, wherein a polarity of the common voltage invertable every predetermined period.

In one aspect of the present invention, a method of driving a liquid crystal display may, for example, include forming a thin film transistor at crossings of gate lines and data lines formed on a first substrate; forming a pixel electrode electrically connected to the thin film transistor; forming a common electrode on a second substrate; forming a layer of liquid crystal material between the first and second substrates; forming a protrusion on the common electrode for controlling an orientation of liquid crystal molecules within the layer of liquid crystal material; applying a pixel voltage signal to the pixel electrode, wherein a polarity of the pixel voltage signal is inverted every predetermined period (e.g., horizontal line period, frame period, etc.); and applying an AC common voltage to the common electrode, wherein the AC common voltage has a predetermined potential difference with the pixel voltage signal, and wherein a polarity of the common voltage is invertable every predetermined period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 2A and 2B illustrate a dot inversion scheme of driving an LCD device;

FIGS. 5A and 5B illustrate a line inversion scheme of driving the LCD device of the present invention;

FIGS. 7A and 7B illustrate a frame inversion scheme of driving an a method of driving the LCD device of the present invention;

DETAILED DESCRIPTION OF THE ILLUSTRATED EMBODIMENTS

Reference will now be made in detail to embodiments of the present invention, examples of which are illustrated in the accompanying drawings.

Figure 4:
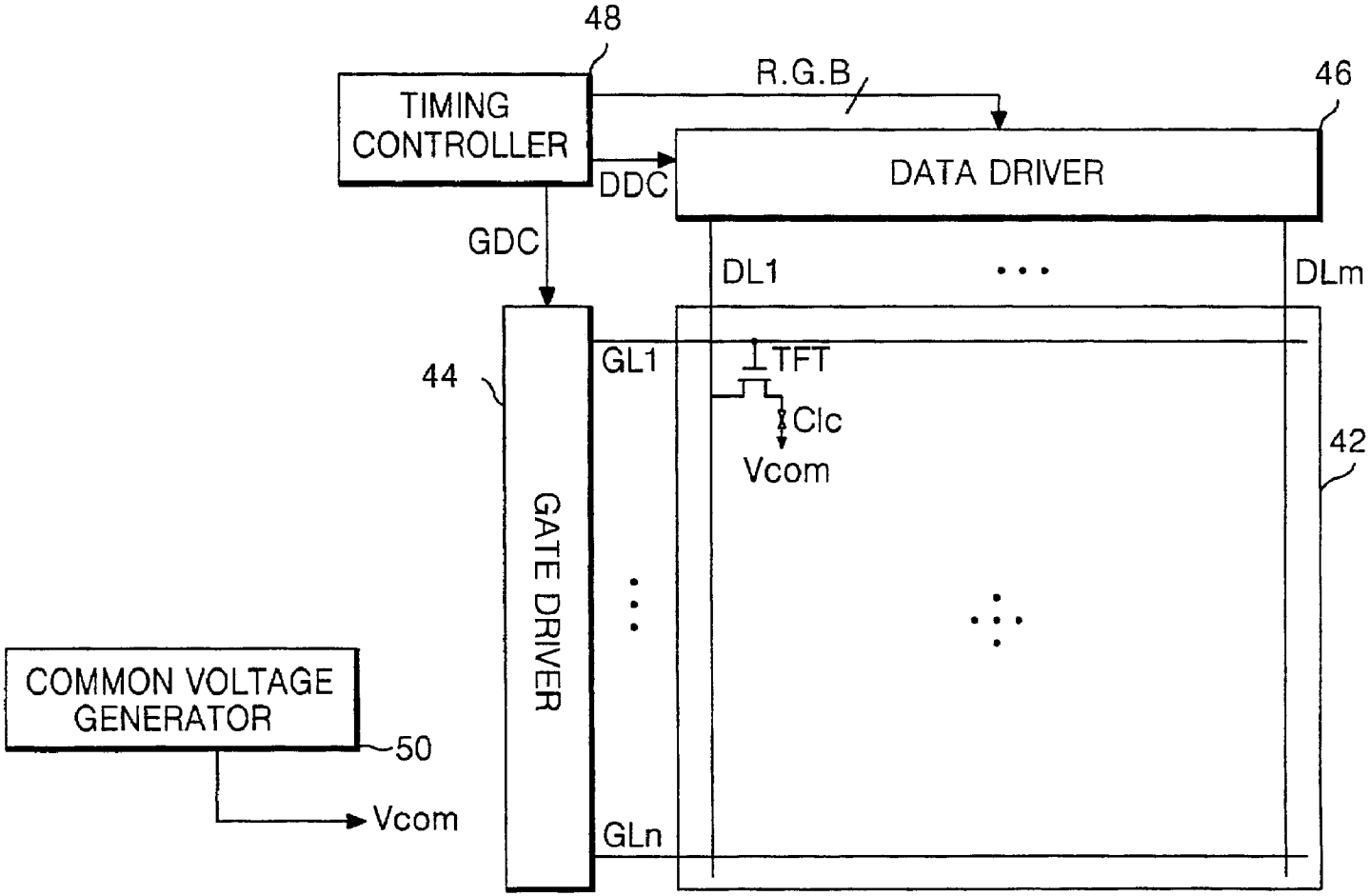
FIG. 4 illustrates a block diagram of a LCD device according to principles of the present invention.

FIG. 4 illustrates a block diagram of a LCD device according to principles of the present invention.

Referring to FIG. 4, a LCD device according may, for example, include a LCD panel 42 supporting a plurality of gate lines GL1 to GLn and a plurality of data lines DL1 to DLm, crossing the plurality of gate lines GL1 to GLn, wherein a plurality of liquid crystal cells, defined by the crossings of the plurality of gate and data lines, are arranged in a matrix pattern; a gate driver 44 for driving the plurality of gate lines GL1 to GLn; a data driver 46 for driving the plurality of data lines DL1 to DLm; a timing controller 48 for controlling the gate and data drivers 44 and 46, respectively; and a common voltage generator 50 for a generating common voltage (Vcom), wherein the common voltage is an AC-type voltage.

Figure 10:
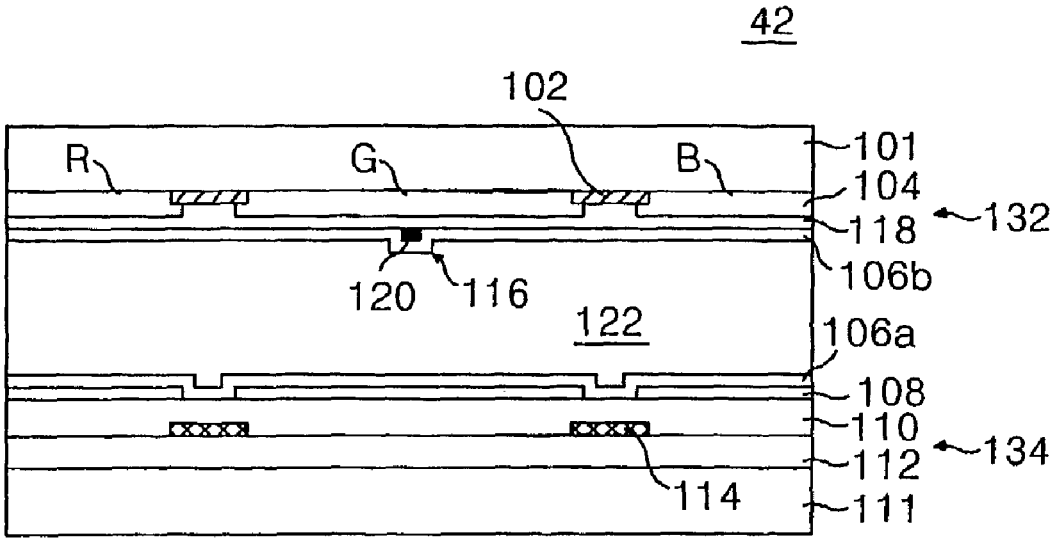
FIG. 10 illustrates a sectional view of an LCD panel in a two-domain TN mode LCD device in accordance with the present invention.

The LCD panel 42 may, for example, be similarly provided as the LCD panel illustrated in FIG. 10. Accordingly, and referring to FIG. 10, the LCD panel 42 may includes a TFT array substrate 134, a color filter array substrate 132 opposing the TFT array substrate 134, and a layer of liquid crystal material 122 arranged between the color filter and TFT array substrates 132 and 134, respectively.

The TFT array substrate 134 may include a lower substrate 111; a plurality of data lines 114 (DL1-DLm of FIG. 4) formed on an insulating layer 112; a plurality gate lines (not shown in FIG. 10 but indicated at GL1-GLn of FIG. 4) crossing the plurality of data lines 114 and divide the lower substrate 111 into a plurality of liquid crystal cells; a plurality of TFTs (not shown) each consisting of a semiconductor layer (not shown) and a source/drain electrode (not shown); a protective film 110 covering and protecting the thin film transistors; a plurality of pixel electrodes 108 formed within pixel areas of each of the liquid crystal cells on the protective film 110 and connected to respective ones of the TFTs; and a lower alignment film 106*a* covering the pixel electrode 108.

According to the principles of the present invention, the plurality of gate lines GL1 to GLn are formed on the lower substrate 134 and the plurality of data lines DL1 to DLm are formed to cross over, and be insulated from, the plurality of gate lines GL1 to GLn. Thin film transistors (TFTs) may be formed at crossings of the plurality of gate and data lines GL1 to GLn and DL1 to DLm, respectively, for selectively applying a pixel voltage signal supplied from the data lines DL1 to DLm to corresponding ones of liquid crystal cells (Clcs), thereby driving the liquid crystal cells. In one aspect of the present invention, a gate terminal of each of the TFTs may be connected to a corresponding one of the gate lines GL and a source terminal of each of the TFTs may be connected to a correspond one of the data lines DL.

The color filter array substrate 132 includes an upper substrate 101; a black matrix 102 formed on the upper substrate 101 for preventing light leakage in regions corresponding to the gate line, the data line 114, and the TFT (not shown); a plurality of color filters 104 arranged between the black matrix 102 and opposing the pixel areas; a common electrode 118 formed over the color filters 104; a protrusion 120, made of an organic material such as an acrylic resin, formed on each common electrode 118 and over each color filter 104; and an upper alignment film 106*b* formed on the protrusion 120.

When a voltage is applied to the LCD panel, an electric field is generated within the liquid crystal layer 122 that drives the liquid crystal molecules within a liquid crystal cell. Where the upper alignment film 106*b* is formed on the protrusion 120, a projected area 116 is formed that distorts the electric field generated within the liquid crystal layer 122. Accordingly, a dielectric energy of the distorted electric field orients directors of liquid crystal molecules in the layer of liquid crystal material 122 in desired directions.

According to the principles of the present invention, and as shown in FIG. 10, liquid crystal cells within the LCD panel 42 may include two domains, where molecules of liquid crystal material within each liquid crystal cell may be driven according to a two-domain mode and be oriented in different directions. Accordingly, each liquid crystal cell may comprise at least two domains, wherein liquid crystal material within each domains is aligned in different directions in order to compensate for a narrow viewing angle.

According to the principles of the present invention, liquid crystal cells within the LCD panel 42 may be charged by pixel voltage signals having polarities that are inverted every predetermined period according to a line inversion scheme or a frame inversion scheme.

In one aspect of the present invention, the gate driver 44 may sequentially apply gate signals (e.g., gate high voltages) to the plurality of gate lines GL1 to GLn using gate control signals (GDC) outputted by the timing controller 48. In another aspect of the present invention, the gate driver 44 may drive TFTs connected to gate lines GL in response to the gate control signals (GDC) one gate line at a time.

In another aspect of the present invention, the data driver 46 may convert digital pixel data (RGB), outputted by the timing controller 48, into analog pixel voltage signals and apply the analog pixel data voltage signals to the data lines DL1 to DLm for each horizontal period (i.e., period of time during which gate signals are applied to a particular gate line GL) as gate high voltages are sequentially applied to the gate lines GL1 to GLn. Further, the data driver 46 may convert the digital pixel data into analog pixel data voltage signals using gamma voltages applied from a gamma voltage generator (not shown). The polarities of the analog pixel voltage signals may be inverted by the data driver 46, wherein the data driver 46 may invert the polarity of the analog pixel voltage signals for each horizontal line, via a line inversion scheme, or for each frame period, via a frame inversion scheme.

In one aspect of the present invention, the timing controller 48 may generate gate and data control signals (GDC) and (DDC), respectively, capable of controlling operations of the gate and data drivers 44 and 46, respectively. Further, the timing controller 48 may also apply digital pixel data signals (RGB) to the data driver 46. The gate control signals (GDC), generated by the timing controller 48, may, for example, include a gate start pulse (GSP), a gate shift clock (GSC) signal, a gate output enable (GOE) signal, etc. The data control signals (DDC), also generated by the timing controller 48, may, for example, include a source start pulse (SSP), a source shift clock (SSC) signal, a source output enable (SOE) signal, a polarity control (POL) signal, etc. According to the principles of the present invention, the polarity control (POL) signal may cause the polarity of the analog pixel voltage signal to be inverted for each horizontal period or for each frame period.

In one aspect of the present invention, the common voltage generator 50 may generate a common voltage (Vcom) capable of being applied to common electrodes of the liquid crystal cells, wherein the common electrodes are separated from corresponding pixel electrodes by a layer of liquid crystal material. According to the principles of the present invention, the common voltage (Vcom) may be provided as an AC-type voltage. Further, the common voltage generator 50 may invert the polarity of common voltage (Vcom) for each horizontal period if liquid crystal cells within the liquid crystal display panel 42 are driven by a line inversion scheme. Still further, the common voltage generator 50 may invert the polarity of the common voltage (Vcom) for each frame period if liquid crystal cells within the liquid crystal display panel 42 are driven by a frame inversion scheme. Accordingly, the difference in potential between the common voltage (Vcom), generated by the common voltage generator 50, and the analog pixel voltage signals, applied to the data lines DL, may be about twice that obtained by LCD devices such as those illustrated in FIG. 1.

FIGS. 5A and 5B illustrate a method of driving liquid crystal cells within the LCD device of the present invention according to a line inversion scheme.

Referring to FIGS. 5A and 5B, liquid crystal cells within the liquid crystal display panel 42 may be charged with analog pixel voltage signals having polarities that are inverted according to a line inversion scheme. Accordingly, the polarity of analog pixel voltage signals applied to the liquid crystal display panel may be inverted for each horizontal line of the liquid crystal display panel 42 and for each frame.

Figure 6:
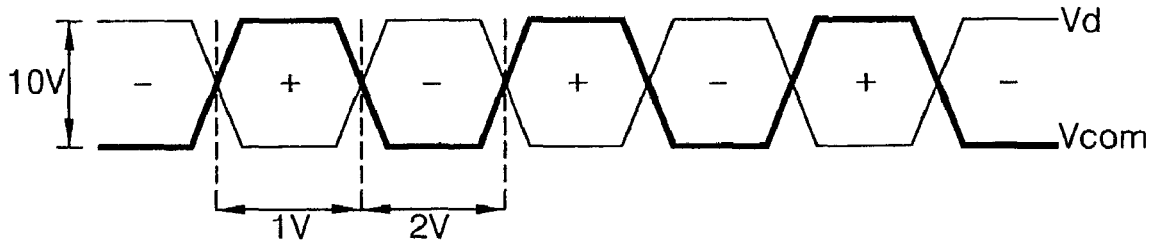
FIG. 6 illustrates a waveform diagram of the relationship between a pixel voltage data signal and a common voltage signal applied to liquid crystal cells of the LCD device of the present invention, driven according to a line inversion scheme.

For example, when analog pixel voltage signals (Vd) are generated according to the line inversion scheme, a positive analog pixel voltage signal (Vd) may be charged within the liquid crystal cells connected to the first gate line GL1 during a first horizontal period 1V (e.g., when a gate high voltage activates the first gate line GL1), as shown in FIG. 6. Therefore, during the first horizontal period 1V, a voltage difference between the positive analog pixel voltage signal (Vd) and the common voltage (Vcom) may be about 10V, wherein the common voltage (Vcom) may be inverted for each horizontal period.

Subsequently, a negative analog pixel voltage signal (Vd) may be charged within the liquid crystal cells connected to the second gate line GL2 during a second horizontal period 2V (e.g., when the gate high voltage activates the second gate line GL2), as shown in FIG. 6. Therefore, during the second horizontal period 2V, a voltage difference between the negative analog pixel voltage signal (Vd) and the common voltage (Vcom) is about 10V, wherein the common voltage (Vcom) may be inverted for each horizontal period.

FIGS. 7A and 7B illustrate a method of driving liquid crystal cells within the LCD device of the present invention according to a frame inversion scheme.

Referring to FIGS. 7A and 7B, liquid crystal cells within the liquid crystal display panel 42 may be charged with analog pixel voltage signals having polarities that are inverted according to a frame inversion scheme. Accordingly, the polarity of analog pixel voltage signals applied to the liquid crystal display panel may be inverted for each frame.

Figure 8:
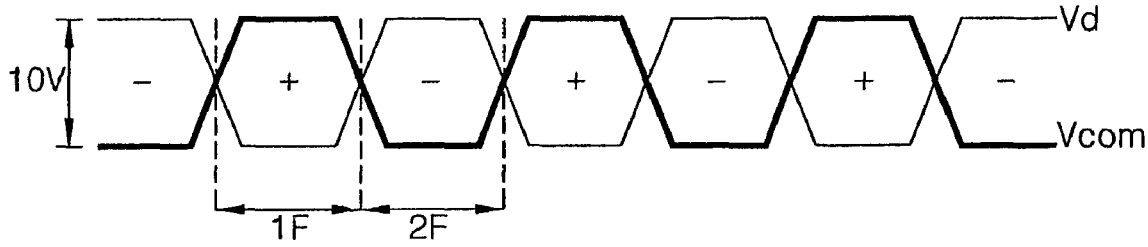
FIG. 8 illustrates a waveform diagram of the relationship between a pixel voltage data signal and a common voltage signal applied to liquid crystal cells of the LCD device of the present invention, driven according to a frame inversion scheme.

For example, when analog pixel voltage signals (Vd) are generated according to the frame inversion scheme, a positive analog pixel voltage signal (Vd) may be charged within the liquid crystal cells connected to the gate lines GL activated during a first frame period 1F, as shown in FIG. 8. Therefore, during the first frame period 1F, a voltage difference between the positive analog pixel voltage signal (Vd) and the common voltage (Vcom) may be about 10V, wherein the common voltage (Vcom) may be inverted for each frame period.

Subsequently, a negative analog pixel voltage signal (Vd) may be charged within the liquid crystal cells connected to the gate lines GL activated during a second frame period 2F, as shown in FIG. 8. Therefore, during the second frame period 2F, a voltage difference between the positive analog pixel voltage signal (Vd) and the common voltage (Vcom) may be about 10V, wherein the common voltage (Vcom) may be inverted for each frame period.

FIGS. 9A to 9D illustrate the relationship between viewing angle characteristics of the LCD device and a voltage difference between the common voltage and a pixel voltage signal.

Figure 1:
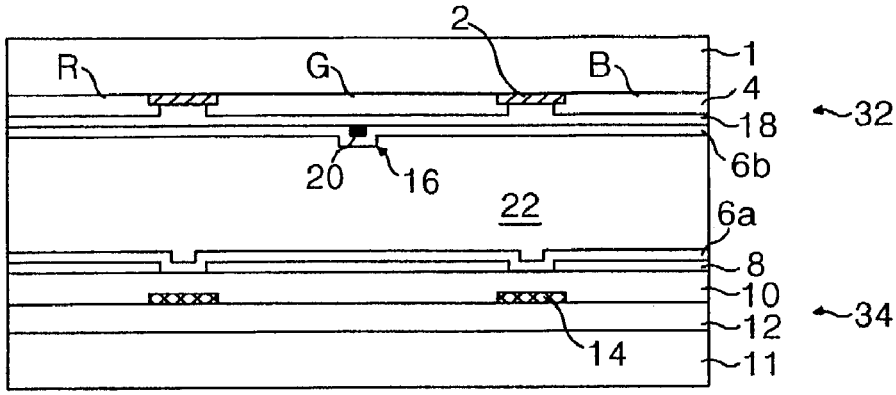
FIG. 1 RELATED ART
FIG. 1 illustrates a sectional view of a LCD panel in a related art, two-domain TN mode LCD device.
Figure 3:
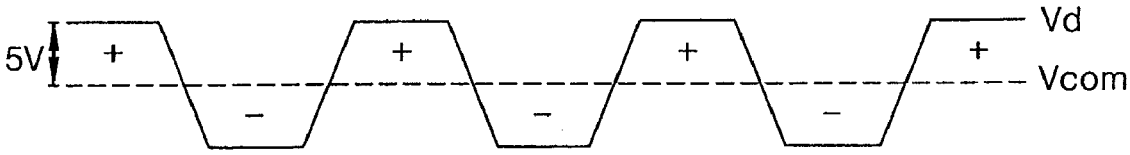
FIG. 3 RELATED ART
FIG. 3 illustrates a waveform diagram of the relationship between a pixel voltage signal and a common voltage applied to liquid crystal cells of the related art LCD device shown in FIG. 1, driven according to the dot inversion scheme shown in FIGS. 2A and 2B.
Figure 9A:
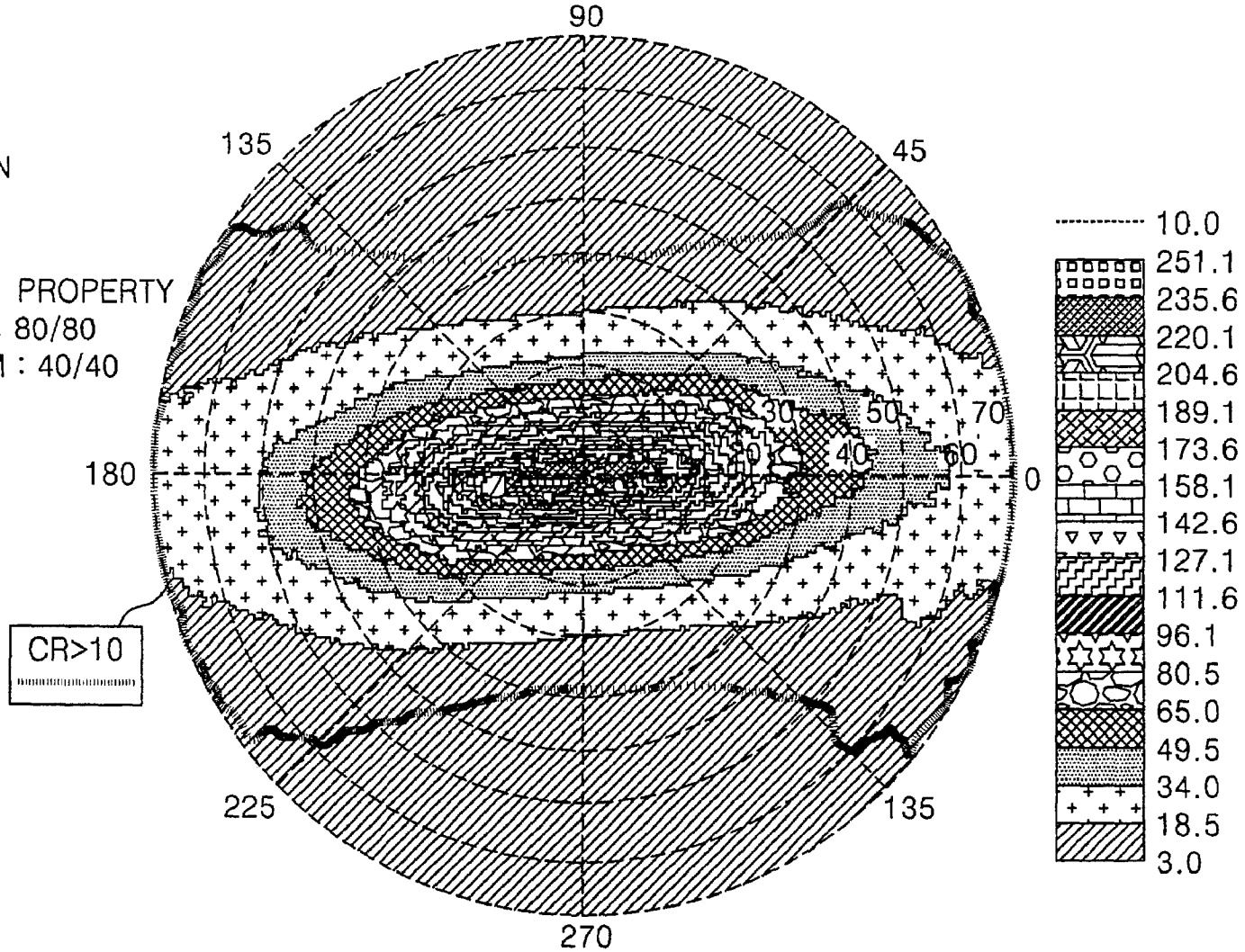
FIGS. 9A to 9D illustrate the relationship between viewing angle characteristics of the LCD device and a voltage difference between the common voltage and a pixel voltage signal.

Referring to FIG. 9A, when a pixel data voltage signal is applied to liquid crystal cells within LCD devices such as those illustrated in FIG. 1, a voltage difference between the applied pixel data voltage signal and the common voltage is about 5V. As a result, the left/right viewing angle of the LCD panel is 80°/80° and the top/bottom viewing angle is 40°/40°.

Figure 9B:
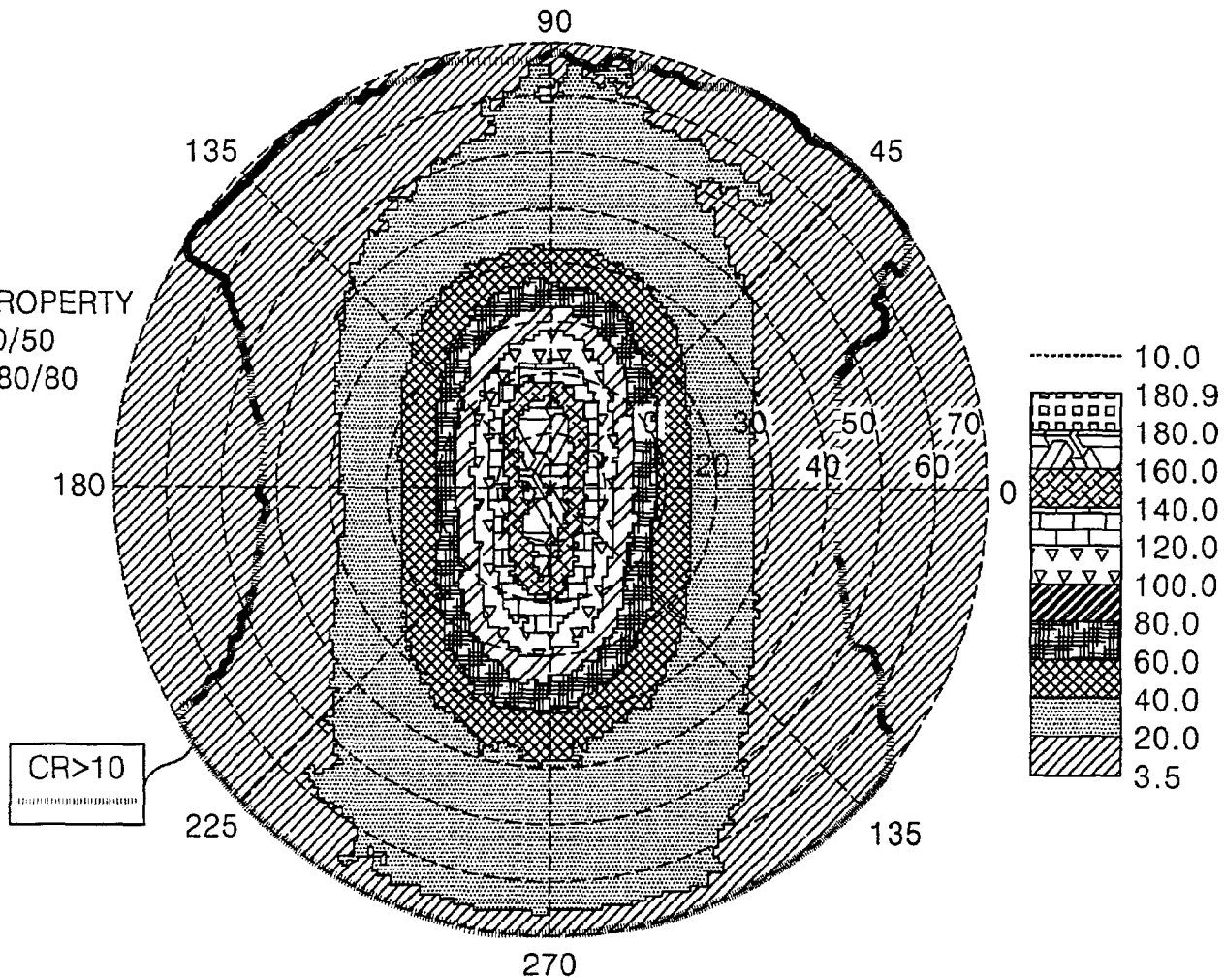
Figure 9C:
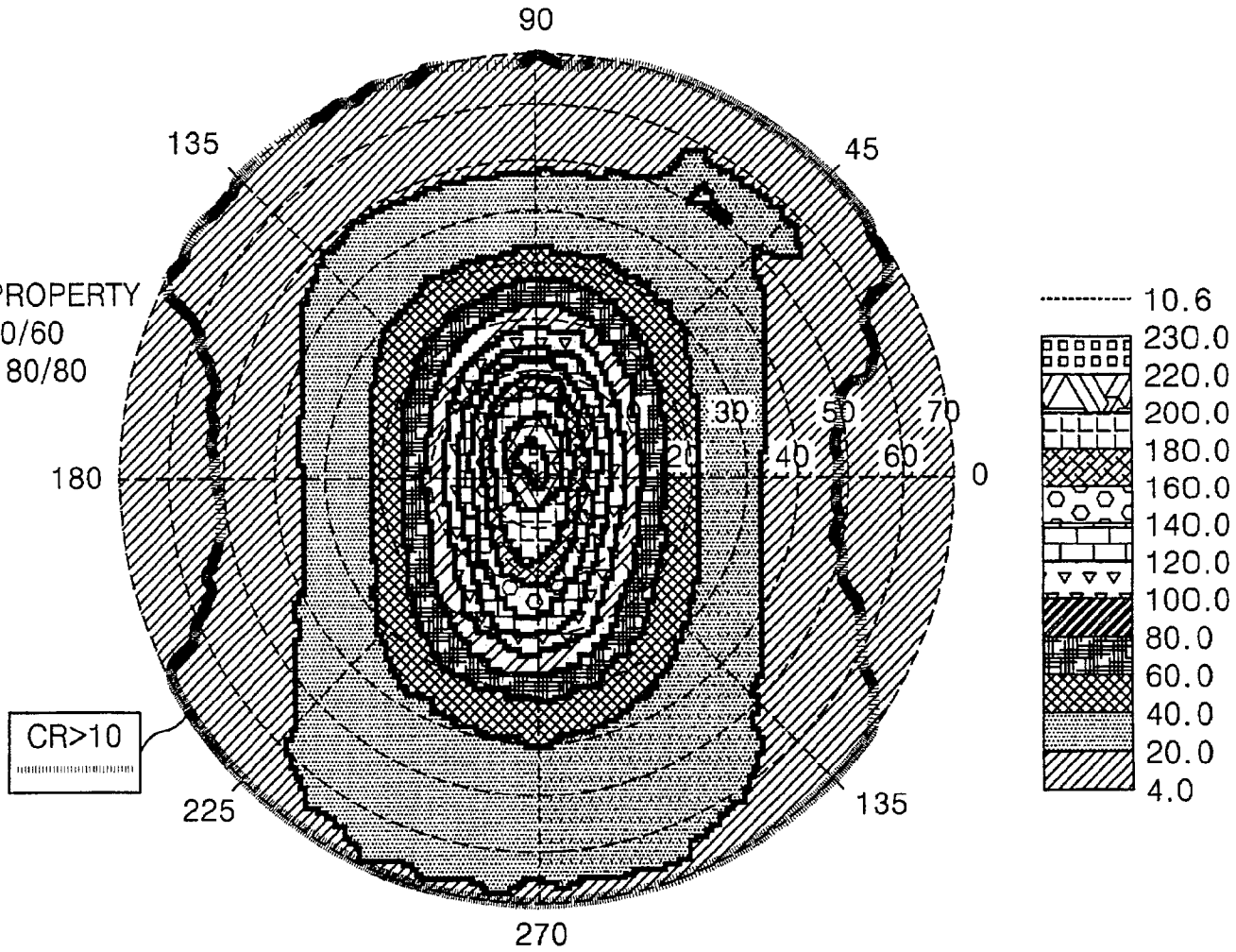

Referring to FIGS. 9B and 9C, when analog pixel voltage signals are applied to liquid crystal cells such that voltage differences between the applied analog pixel voltage signal and the common voltage are about 7V and 8V, respectively, the left/right viewing angles decrease relative to the left/right viewing angle obtained via the aforementioned 5V voltage difference while the top/bottom viewing angles obtained via the 7V and 8V voltage difference increases relative to the top/bottom viewing angle obtained via the aforementioned 5V difference.

Figure 9D:
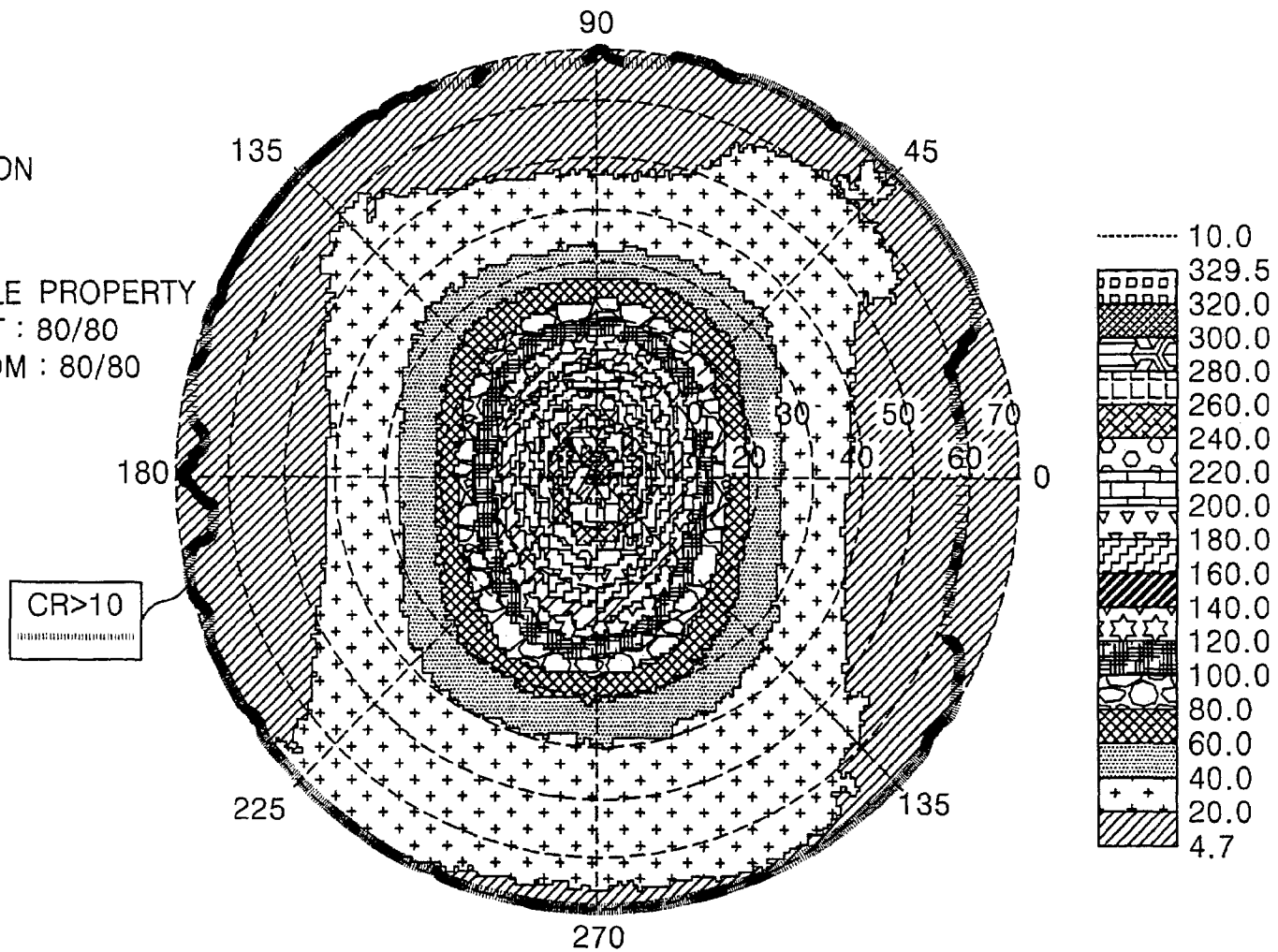

Referring to FIG. 9D, when an analog pixel voltage signal is applied to liquid crystal cells within the LCD device according to principles of the present invention, a voltage difference between the applied analog pixel voltage signal and the common voltage is about 10V (approximately double the voltage difference obtained in LCD devices such as those illustrated in FIG. 1), the left/right viewing angle is 80°/80° while the top/bottom viewing angle is approximately 80°/80° (approximately double the top/bottom viewing angle obtained in LCD devices such as those illustrated in FIG. 1).

In one aspect of the present invention, the thin film transistors (TFTs) may be formed of amorphous silicon. In another aspect of the present invention, the thin film transistors (TFTs) may be formed of polycrystalline silicon. TFTs formed of polycrystalline silicon have a response speed faster than that of TFTs formed of amorphous silicon. Accordingly, in one aspect of the present invention, liquid crystal cells driven by TFTs formed of polycrystalline silicon may be driven according to at least any one of a dot inversion or column inversion scheme, wherein analog pixel voltage signals having different polarities may be simultaneously applied to the liquid crystal cells connected to the first to $m^{th}$ data lines DL1 to DLm. Further, a voltage level of the common voltage (Vcom) may be adjusted as similarly described above such that the potential difference between the applied analog pixel voltage signals (Vd) and the common voltage (Vcom) is about 10V (about twice the voltage difference obtained in LCD devices such as those illustrated in FIG. 1). Accordingly, the analog pixel voltage signals, corresponding to activated gate line(s) GLi and applied to data lines DL1 to DLm, may be used to selectively adjust the light transmittance characteristics of a layer of liquid crystal material within the liquid crystal cells.

According to the principles of the present invention, a polarity of the common voltage (Vcom) may be inverted according to at least one of a horizontal period and a frame period. Additionally, a voltage level of the common voltage may be adjusted such that a potential difference (e.g., about 10V) between an applied analog pixel voltage signal and the adjusted common voltage is about twice that obtained in the aforementioned related art. Accordingly, an orientation change of liquid crystal molecules arranged proximate a projected area of a common electrode in the LCD device of the present invention can be efficiently accomplished upon the application of analog pixel voltage signals to data lines, wherein a potential difference (e.g., about 10V) between the common voltage and the analog pixel voltage signal is about twice that of the related art. According to the principles of the present invention, an overall viewing angle may be increased and the necessity of a wide viewing angle film may be eliminated, even when the data driver of the related art LCD device is used.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a first substrate;

a plurality of gate lines on the first substrate;

a plurality of data lines on the first substrate, crossing the plurality of gate lines;

thin film transistors arranged at crossings of the plurality of gate and data lines;

pixel electrodes connected to the thin film transistors;

a second substrate;

a common electrode on the second substrate;

a layer of liquid crystal material between the first and second substrates;

a protrusion on the common electrode for controlling an orientation direction of the liquid crystal layer so as to form different orientation directions in the liquid crystal layer;

a common voltage generator applying a common voltage to the common electrode, wherein the common voltage is an AC voltage having a predetermined period;

a data driver that applies a pixel voltage signal to the plurality of data lines;

a gate driver for driving the plurality of gate lines; and a timing controller for controlling the gate and data drivers and for applying a pixel data signal to the data driver;

wherein a potential difference between the common voltage and the pixel voltage signal is set to a predetermined value to control the orientation of liquid crystal molecules arranged proximately to a projected area of the common electrode, wherein a polarity of the pixel voltage signal is inverted every horizontal period and frame period, and a polarity of the common voltage is inverted every horizontal period and frame period, wherein the layer of liquid crystal material is driven according to a two-domain twist nematic mode, and wherein a potential difference between the common voltage and a positive pixel voltage signal is about 10 V and a potential difference between the common voltage and a negative pixel voltage signal is about 10 V, wherein a left/right viewing angle of the liquid crystal display device is 80°/80° while a top/bottom viewing angle is 80°/80°, wherein the thin film transistors (TFTs) is formed of polycrystalline silicon.

2. The device according to claim 1, wherein the portions of the layer of liquid crystal material are aligned in different directions within domain.

3. A method of driving a liquid crystal display device, comprising:

providing a first substrate;

providing a plurality of gate lines on the first substrate;

providing a plurality of data lines on the first substrate and crossing the plurality of gate lines;

forming thin film transistors at crossings of the plurality of gate and data lines;

forming pixel electrodes connected to the thin film transistors;

providing a second substrate;

forming a common electrode on the second substrate;

forming a protrusion on the common electrode;

forming a liquid crystal layer between the first and second substrates, wherein the protrusion is capable of controlling an orientation direction of the liquid crystal layer so as to form different orientation directions in the liquid crystal layer;

applying a pixel voltage signal to the pixel electrodes, wherein a polarity of the pixel voltage signal is periodically inverted; and applying a common voltage to the common electrode, wherein the common voltage has a predetermined potential difference from the pixel voltage signal to control the orientation of liquid crystal molecules arranged proximately to a projected area of the common electrode, wherein a polarity of the pixel voltage signal is inverted every horizontal period and frame period, and a polarity of the common voltage is inverted every horizontal period and frame period, wherein the layer of liquid crystal material is driven according to a two-domain twist nematic mode, and wherein a potential difference between the common voltage and a positive pixel voltage signal is about 10 V and a potential difference between the common voltage and a negative pixel voltage signal is about 10 V, wherein a left/right viewing angle of the liquid crystal display device is 80°/80° while a top/bottom viewing angle is 80°/80°, wherein the thin film transistors (TFTs) is formed of polycrystalline silicon.

4. The method according to claim 3, wherein portions of the layer of liquid crystal material are aligned in different directions within each domain.

5. A liquid crystal display device, comprising:

a liquid crystal display panel, the liquid crystal display panel including a plurality of data lines and a common electrode, wherein the liquid crystal display panel has a liquid crystal layer having different orientation directions;

thin film transistors arranged at crossings the data lines and a plurality of gate lines, an active semiconductor layer of the thin film transistors including polycrystalline silicon material;

a data driver for applying a pixel voltage signal to the plurality of data lines according to a predetermined driving scheme; and a common voltage generator for applying a common voltage to the common electrode, wherein a polarity of the common voltage is inverted corresponding to the polarity of the pixel voltage signal based on the predetermined driving scheme to control the orientation of liquid crystal molecules arranged proximately to a projected area of the common electrode, wherein the predetermined driving scheme includes a line inversion scheme and a frame inversion scheme, wherein the liquid crystal layer is driven according to a two-domain twist nematic mode, wherein a potential difference between the common voltage and a positive pixel voltage signal is about 10 V and a potential difference between the common voltage and a negative pixel voltage signal is about 10 V, wherein a left/right viewing angle of the liquid crystal display device is 80°/80° while a top/bottom viewing angle is 80°/80°, wherein the thin film transistors (TFTs) is formed of polycrystalline silicon.

* * * * *